US010576614B2

(12) United States Patent
Wang

(10) Patent No.: US 10,576,614 B2
(45) Date of Patent: Mar. 3, 2020

(54) STAPLER

(71) Applicant: APEX MFG. CO., LTD., Taichung (TW)

(72) Inventor: Jing-Li Wang, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 213 days.

(21) Appl. No.: 15/825,932

(22) Filed: Nov. 29, 2017

(65) Prior Publication Data

US 2019/0160641 A1 May 30, 2019

(51) Int. Cl.

| | |
|---|---|
| ***B25C 5/02*** | (2006.01) |
| ***B25C 5/16*** | (2006.01) |
| ***B25C 5/11*** | (2006.01) |
| ***B25C 5/06*** | (2006.01) |

(52) U.S. Cl.

CPC ..... *B25C 5/0285* (2013.01); *B25C 5/0242* (2013.01); *B25C 5/06* (2013.01); *B25C 5/11* (2013.01); *B25C 5/1617* (2013.01)

(58) Field of Classification Search

CPC ..... B25C 5/06; B25C 5/11; B25C 5/1617; B25C 5/0285

USPC ..... 227/129

See application file for complete search history.

(56) References Cited

U.S. PATENT DOCUMENTS

| | | | | |
|---|---|---|---|---|
| 2,006,054 | A * | 6/1935 | Maynard | B25C 5/0285 227/126 |
| 2,037,461 | A * | 4/1936 | Drypolcher | B25C 5/0285 227/124 |
| 2,137,642 | A * | 11/1938 | Cavanagh | B25C 5/0285 227/132 |
| 2,202,259 | A * | 5/1940 | MacDonald | B25C 5/0285 227/124 |
| 7,464,845 | B2 * | 12/2008 | Chou | B25C 5/11 227/127 |
| 7,665,645 | B2 * | 2/2010 | Smith | B25C 5/0207 227/155 |

FOREIGN PATENT DOCUMENTS

| | | |
|---|---|---|
| TW | I397458 B | 6/2013 |

* cited by examiner

*Primary Examiner* — Alexander M Valvis
*Assistant Examiner* — Scott A Howell
(74) *Attorney, Agent, or Firm* — Muncy, Geissler, Olds & Lowe, PC

(57) ABSTRACT

A stapler is provided, including: a main body, having a front end and a rear end; a magazine, disposed in the main body having an outlet end; a striker, disposed in the main body and located between the front end and the outlet end along the longitudinal direction; a driving mechanism, connected to the striker to optionally drive the striker to strike the staple; a pressing element, located in the main body and between the striker and the outlet end along the longitudinal direction, the pressing element being movable between an original position and a pressed position, the original position being higher than the pressed position, the pressing element having a tendency to stay on the original position, when the pressing element is located on the pressed position, the pressing element presses the staples which are exposed outside the outlet end of the magazine.

6 Claims, 6 Drawing Sheets

STAPLER

BACKGROUND OF THE INVENTION

Field of the Invention

The present invention relates to a stapler.

Description of the Prior Art

A conventional stapler, as disclosed in TWI397458, usually includes a shell, a magazine, a striker and a driving mechanism (including operation components like a pressing handle), the magazine is for receiving a plurality of staples and disposed in the shell, the striker is disposed on a front end of the shell to strike one of the plurality staples at the foremost end of the magazine, and the driving mechanism is connected to the striker to drive the striker to strike one of the staples.

Because the magazine is adapted for staples in different lengths, to smoothly strike the staple which is longer, there will normally be a small gap at the front end of the magazine so as to expose a part of the staple at the front end.

However, when the striker strikes the staple which is foremost downward, the striking force will also influence the staples which are exposed but not struck yet, so these staples may be pulled and become skewed or stuck, and each strike may strike more than one staple. It is inconvenient for a user to use the conventional staple and may easily damage the conventional staple.

The present invention has arisen to mitigate and/or obviate the afore-described disadvantages.

SUMMARY OF THE INVENTION

The major object of the present invention is to provide a stapler, which can prevent a staple from being skewed or stuck.

To achieve the above and other objects, a stapler is provided, including a main body, a magazine, a striker, a driving mechanism and a pressing element.

The main body has a front end and a rear end, and a connection between the front end and the rear end defines a longitudinal direction; the magazine is disposed in the main body for receiving a plurality of staples, the magazine has an outlet end, and the outlet end is closer to the front end of the main body; the striker is disposed in the main body and located between the front end of the main body and the outlet end of the magazine along the longitudinal direction, and the striker is for striking a foremost one of the plurality of staples of the magazine; the driving mechanism is connected to the striker to optionally drive the striker to strike the staple which is foremost downward; the pressing element is located in the main body and between the striker and the outlet end of the magazine along the longitudinal direction, the pressing element is movable between an original position and a pressed position, the original position is higher than the pressed position, the pressing element has a tendency to stay on the original position, and when the pressing element is located on the pressed position, the pressing element presses the staples which are exposed outside the outlet end of the magazine.

To achieve the above and other objects, a stapler is further provided, including a main body, a magazine, a striker, a driving mechanism and a pressing element.

The main body has a front end and a rear end, and a connection between the front end and the rear end defines a longitudinal direction; the magazine is disposed in the main body for receiving a plurality of staples, the magazine has an outlet end, the outlet end is closer to the front end of the main body, the magazine further has a first elastic member, and the first elastic member is for pushing the staples toward the outlet end; the striker is disposed in the main body and located between the front end of the main body and the outlet end of the magazine along the longitudinal direction, and the striker is for striking a foremost one of the plurality of staples of the magazine; the driving mechanism is connected to the striker to optionally drive the striker to strike the staple which is foremost downward; the pressing element is located in the main body and between the striker and the outlet end of the magazine along the longitudinal direction, the pressing element is pushed by a second elastic member and has a tendency to move downward, an elasticity coefficient of the second elastic member and an elasticity coefficient of the first elastic member is substantially the same so that the pressing element normally presses the staples which are exposed outside the outlet end of the magazine.

The stapler of the present invention can press the staple which is exposed outside the magazine but not struck yet to prevent a striking force from making the staples which are near the staple struck be skewed or stuck when the foremost staple is struck and to ensure that the other staples move forward smoothly.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
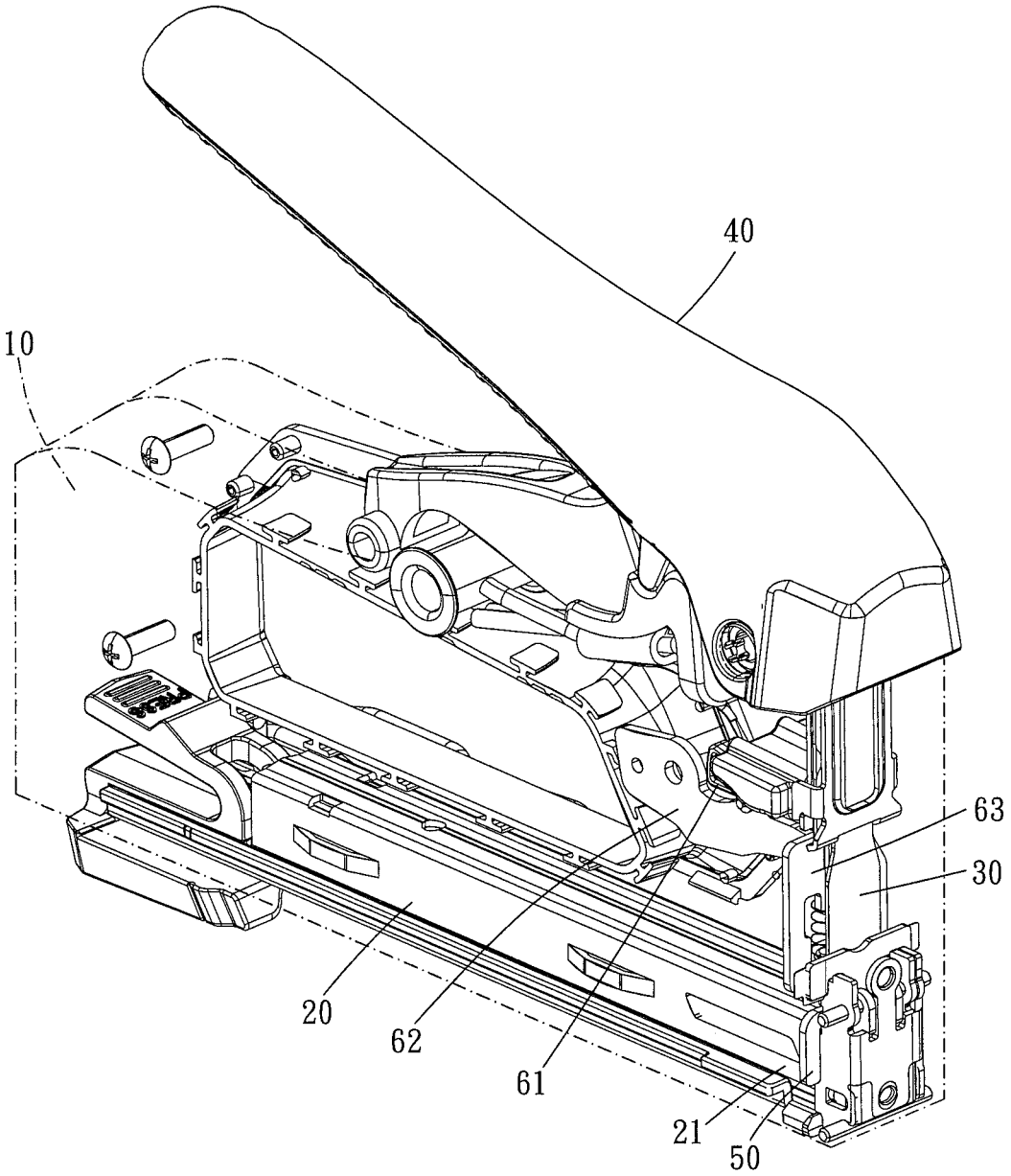
FIG. 1 is a stereogram of the present invention.
Figure 2:
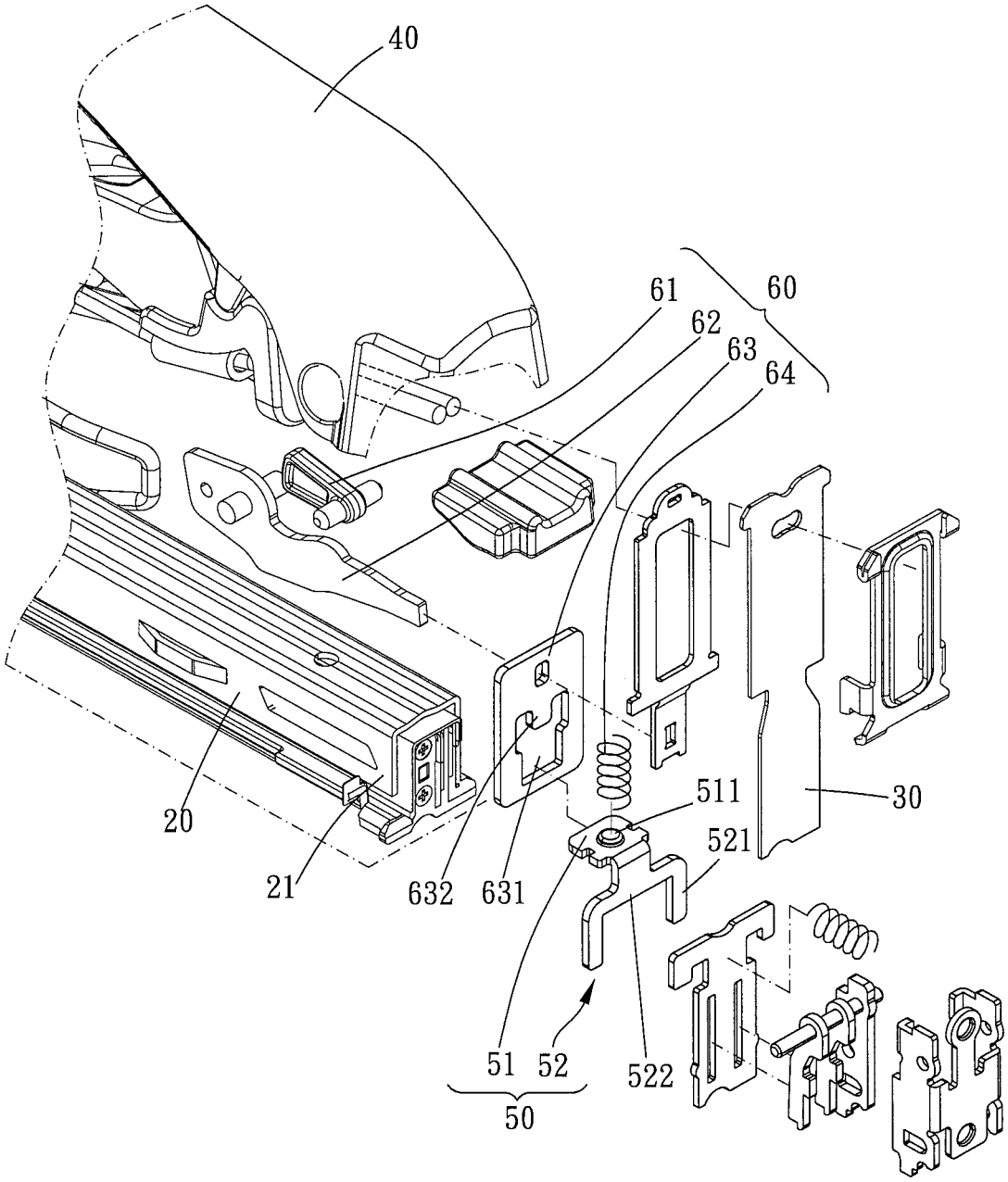
FIG. 2 is a partial stereogram of the present invention.
Figure 3:
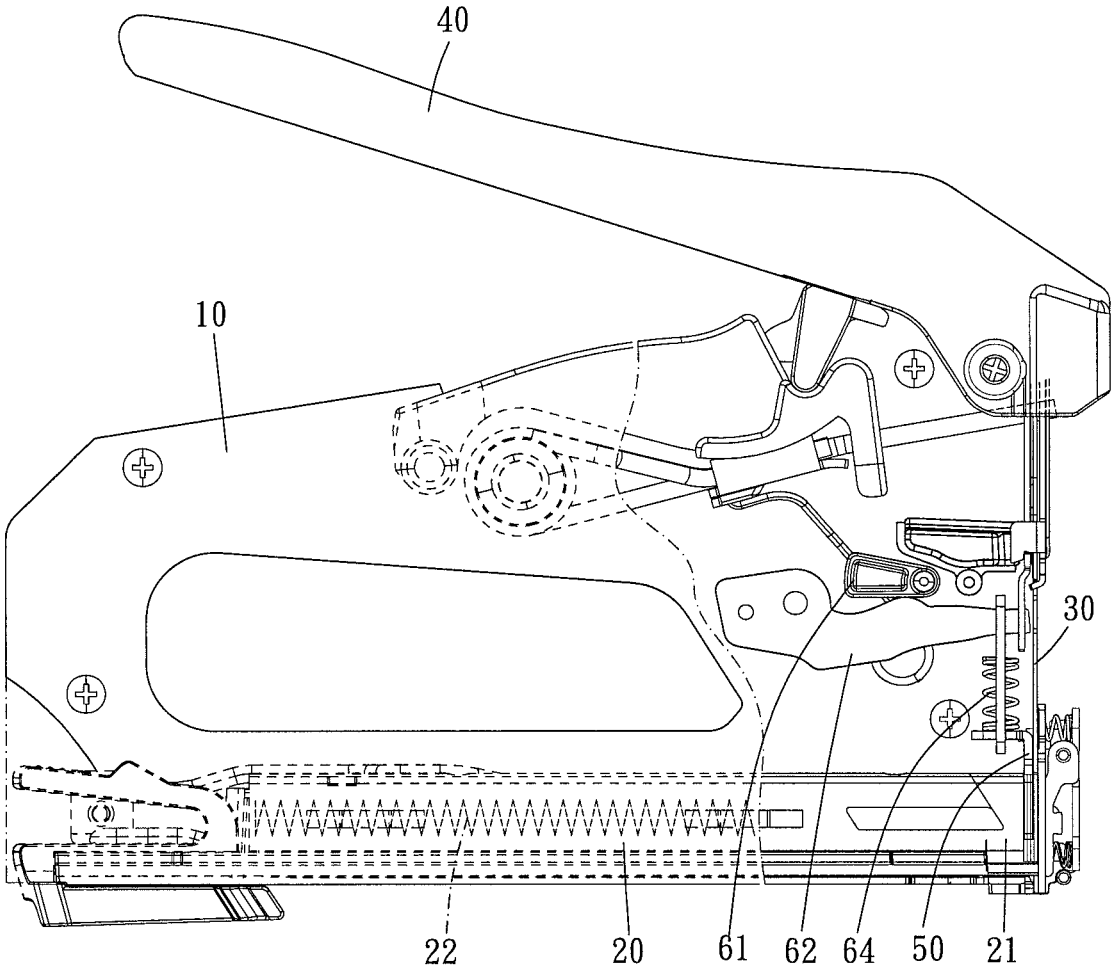
FIG. 3 is a cross-sectional view of the present invention.
Figure 4:
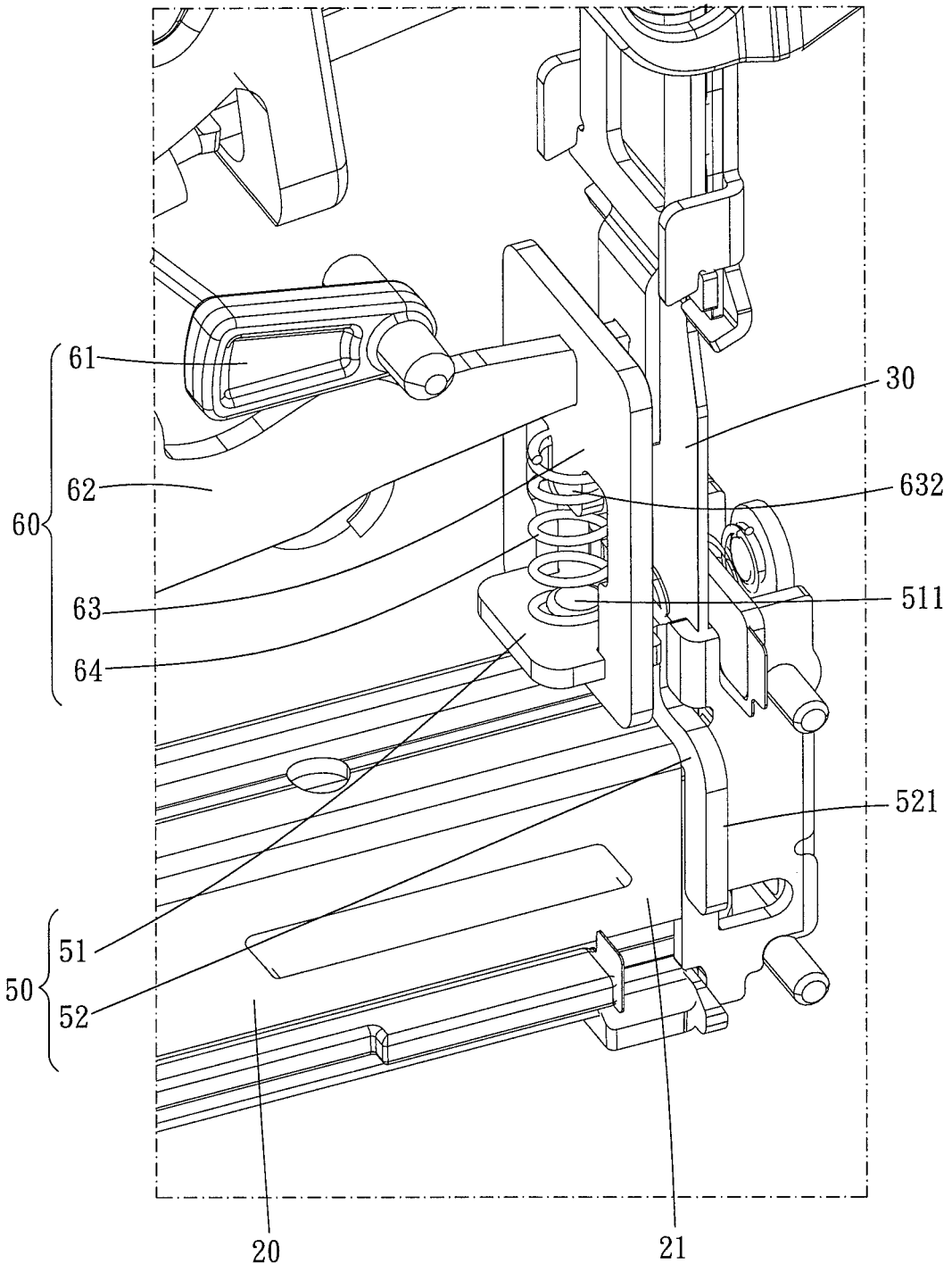
FIG. 4 is a partial perspective view of the present invention.
Figure 5:
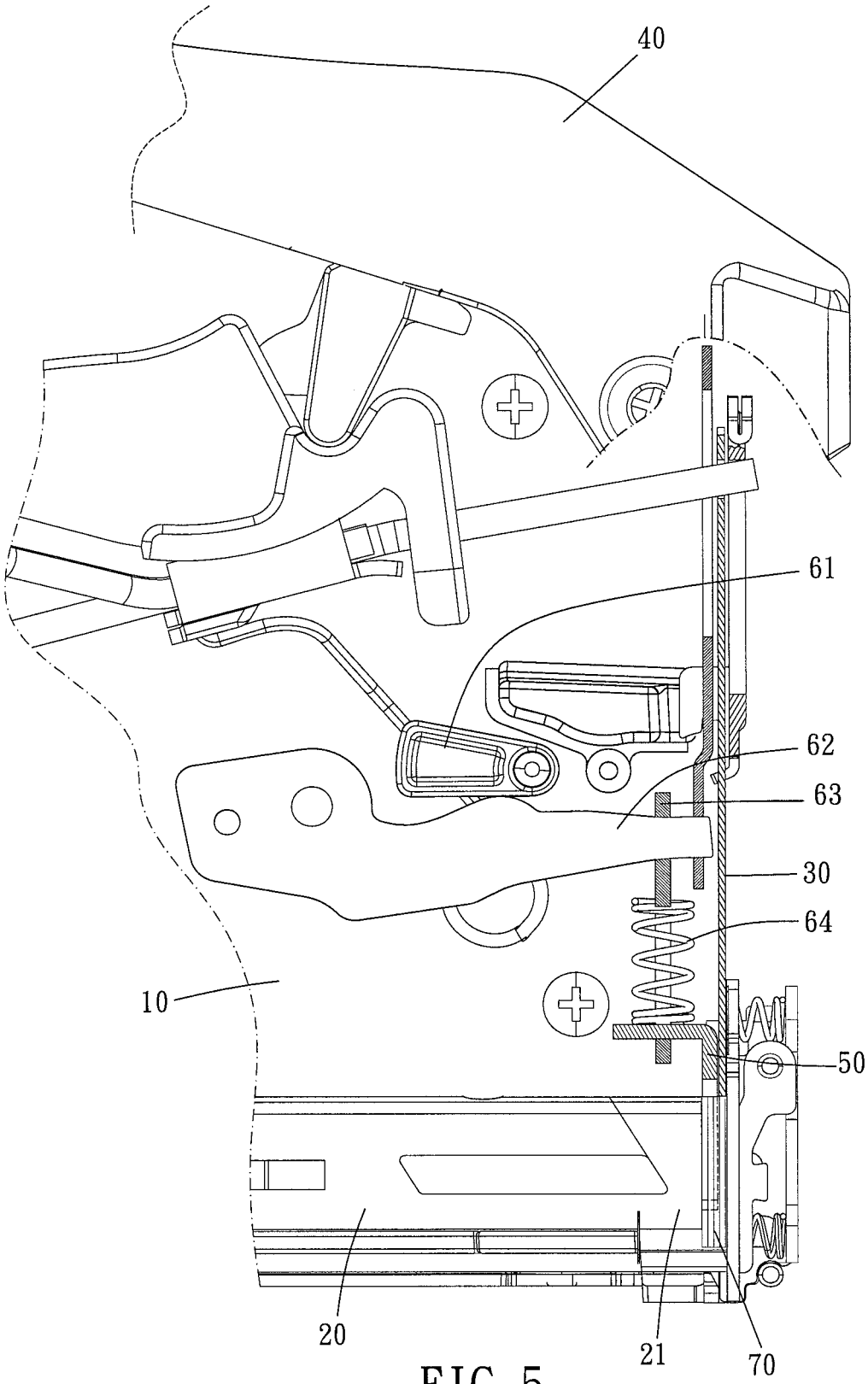
FIGS. 5 and 6 are drawings showing the present invention in operation.
Figure 6:
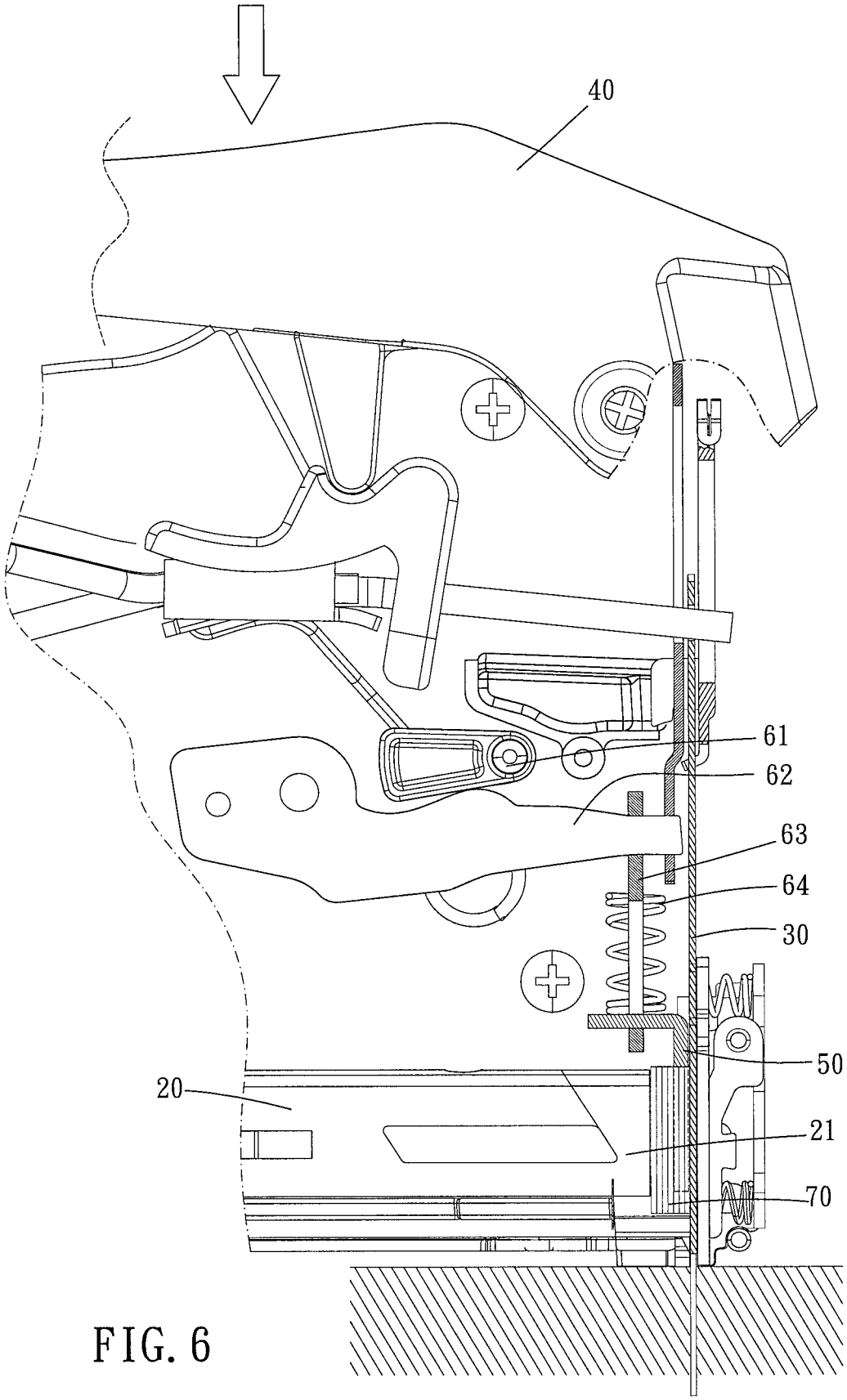

Please refer to FIGS. 1 to 6 for a stapler, including a main body 10, a magazine 20, a striker 30, a driving mechanism and a pressing element 50.

The main body 10 has a front end and a rear end, and a connection between the front end and the rear end defines a longitudinal direction; the magazine 20 is disposed in the main body 10 for receiving a plurality of staples 70, the magazine 20 has an outlet end 21, and the outlet end 21 is closer to the front end of the main body 10; the striker 30 is disposed in the main body 10 and located between the front end of the main body 10 and the outlet end 21 of the magazine 20 along the longitudinal direction, and the striker 30 is for striking a foremost one of the plurality of staples 70 of the magazine 20; the driving mechanism is connected to the striker 30 to optionally drive the striker 30 to strike the staple 70 which is foremost downward; the pressing element 50 is located in the main body 10 and between the striker 30 and the outlet end 21 of the magazine 20 along the longitudinal direction, the pressing element 50 is movable between an original position and a pressed position, the original position is higher than the pressed position, the pressing element 50 has a tendency to stay on the original position, and when the pressing element 50 is located on the pressed position, the pressing element 50 presses the staples 70 which are exposed outside the outlet end 21 of the magazine 20. Preferably, the pressing element 50 is connected to the driving mechanism, and when the driving mechanism drives the striker 30 to strike the staple 70 which is foremost downward, the pressing element 50 is synchronously driven to move downward to the pressing position; however, the pressing element may also be driven to move in other ways.

Specifically, the driving mechanism includes a pressing handle 40, the stapler further includes a transmission mechanism 60, the transmission mechanism 60 is located between the pressing handle 40 and the pressing element 50, when the pressing handle 40 is pressed, the transmission mechanism 60 is driven by the pressing handle 40 to drive the pressing element 50 to move downward, and the striker 30 strikes the staple 70 which is foremost downward. More specifically, the transmission mechanism 60 includes a first swinging arm 61, a second swinging arm 62 and a connecting sheet 63 which is movable upward and downward, the first swinging arm 61 is located above the second swinging arm 62, the first swinging arm 61 and the second swinging arm 62 are pivoted to the main body 10 facing each other, a top end of the connecting sheet 63 is connected to the second swinging arm 62, a bottom end of the connecting sheet 63 is connected to a top end of the pressing element 50, when the first swinging arm 61 is pressed by the pressing handle 40 to swing, the second swinging arm 62 is abutted by the first swinging arm 61 to swing downward, and the connecting sheet 63 and the pressing element 50 are driven to move downward. Specifically, the connecting sheet 63 has a through hole 631, the pressing element 50 includes an upper portion 51 and a lower portion 52, the upper portion 51 is plate-shaped and extends along the longitudinal direction toward the rear end of the main body 10, a vertical profile of the lower portion 52 is substantially n-shaped, the lower portion 52 has two legs 521, the two legs 521 define a staple abutting portion 522 therebetween, the two legs 521 saddle by two sides of the staples 70 which are exposed outside the outlet end 21 of the magazine 20, the staple abutting portion 522 is for abutting against the staples 70, the upper portion 51 is disposed through the through hole 631 of the connecting sheet 63 and located on a lower end of the through hole 631, and a second elastic member 64 is arranged between a wall of an upper end of the through hole 631 and the upper portion of the pressing element 50. Preferably, the wall of the upper end of the through hole 631 of the connecting sheet 63 has a protrusive column 632, a top face of the upper portion 51 of the pressing element 50 has a protrusion 511, and two ends of the second elastic member 64 are respectively sleeved on the protrusive column 632 and the protrusion 511.

Through the above-mentioned structure, the pressing element 50 can move downward to abut against the staples 70 during the process of the pressing handle being pressed, and the pressing element 50 normally just contact the staples 70 lightly and does not press the staples 70 so that the staples 70 can move forward smoothly without being obstructed by the pressing element 50. Therefore, the staples 70 which are exposed but not struck yet can be abutted by the pressing element 50 to prevent from being influenced by the striking force and skewed or stuck so that the staples can move smoothly.

In addition to the pressing element which can move upward and downward to optionally abut against the staples, the other embodiment of the present invention is provided with another structure. The stapler also includes the main body 10, the magazine 20, the striker 30, the driving mechanism and the pressing element 50, the magazine 20 has a first elastic member 22, the first elastic member 22 is for pushing the staples 70 toward the outlet end 21, the pressing element 50 is pushed by a second elastic member 64 and has a tendency to move downward, an elasticity coefficient of the second elastic member 64 and an elasticity coefficient of the first elastic member 22 are substantially the same so that the pressing element 50 normally presses the staples 70 which are exposed outside the outlet end 21 of the magazine 20.

Specifically, the pressing element 50 may maintain on a fixed position by being abutted by the second elastic member 64 instead of moving upward and downward with the driving mechanism. The first and second elastic members 22, 64 have substantially the same elasticity coefficients, so even if the pressing element 50 abuts against the staples 70 normally, the first elastic member 22 is not influenced and can push the staples 70 to move forward smoothly, and the staples 70 which are exposed can be prevented from being skewed while being abutted by the pressing element 50.

Given the above, the stapler of the present invention can keep the staples moving forward while abutting against the staples which have not been struck yet to prevent the staples from being influenced by the striking force and skewed or stuck and further prevent the stapler from being damaged.

While we have shown and described various embodiments in accordance with the present invention, it should be clear to those skilled in the art that further embodiments may be made without departing from the scope of the present invention.

What is claimed is:

1. A stapler, including:

a main body, having a front end and a rear end, a connection between the front end and the rear end defining a longitudinal direction;

a magazine, disposed in the main body for receiving a plurality of staples, the magazine having an outlet end, the outlet end being closer to the front end of the main body;

a striker, disposed in the main body, located between the front end of the main body and the outlet end of the magazine along the longitudinal direction, the striker for striking a foremost one of the plurality of staples of the magazine;

a driving mechanism, connected to the striker to drive the striker to strike the staple that is contacted by the striker in stapler operation;

a pressing element, located in the main body and between the striker and the outlet end of the magazine along the longitudinal direction, the pressing element being movable between an original position and a pressed position, the original position being higher than the pressed position, the pressing element being in the original position when not in operation, when the pressing element is located on the pressed position, the pressing element presses the staples which are exposed outside the outlet end of the magazine;

wherein the driving mechanism includes a pressing handle, the stapler further includes a transmission mechanism, the transmission mechanism is located between the pressing handle and the pressing element, when the pressing handle is pressed, the transmission mechanism is driven by the pressing handle to drive the pressing element to move downward, and the striker strikes the staple that is contacted by the striker in stapler operation;

wherein the transmission mechanism includes a first swinging arm, a second swinging arm and a connecting sheet, the first swinging arm is located above the second swinging arm, the first swinging arm and the second swinging arm are pivoted to the main body facing each other, a top end of the connecting sheet is connected to the second swinging arm, a bottom end of the connecting sheet is connected to a top end of the pressing element, when the first swinging arm is pressed by the pressing handle to swing, the second swinging arm is abutted by the first swinging arm to swing downward, and the connecting sheet and the pressing element are driven to move downward;

wherein the connecting sheet has a through hole, the pressing element includes an upper portion and a lower portion, the upper portion is plate-shaped and extends along the longitudinal direction toward the rear end of the main body, a vertical profile of the lower portion is substantially n-shaped, the lower portion has two legs, the two legs define a staple abutting portion therebetween, the two legs saddle by two sides of the staples which are exposed outside the outlet end of the magazine, the staple abutting portion is for abutting against the staples, the upper portion of the pressing element is disposed through the through hole of the connecting sheet and located on a lower end of the through hole, and a second elastic member is arranged between a wall of an upper end of the through hole and the upper portion of the pressing element.

2. The stapler of claim 1, wherein the pressing element is connected to the driving mechanism, and when the driving mechanism drives the striker to strike the staple that is contacted by the striker in stapler operation, the pressing element is synchronously driven to move downward to the pressing position.

3. The stapler of claim 1, wherein the wall of the upper end of the through hole of the connecting sheet has a protrusive column, a top face of the upper portion of the pressing element has a protrusion, and two ends of the second elastic member are respectively sleeved on the protrusive column and the protrusion.

4. A stapler, including:

a main body, having a front end and a rear end, a connection between the front end and the rear end defining a longitudinal direction;

a magazine, disposed in the main body for receiving a plurality of staples, the magazine having an outlet end, the outlet end being closer to the front end of the main body, the magazine further having a first elastic member, the first elastic member for pushing the staples toward the outlet end;

a striker, disposed in the main body and located between the front end of the main body and the outlet end of the magazine along the longitudinal direction, the striker for striking a foremost one of the plurality of staples of the magazine;

a driving mechanism, connected to the striker to drive the striker to strike the staple that is contacted by the striker in stapler operation;

a pressing element, located in the main body and between the striker and the outlet end of the magazine along the longitudinal direction, the pressing element being pushed by a second elastic member, an elasticity coefficient of the second elastic member and an elasticity coefficient of the first elastic member being substantially the same so that the pressing element normally presses the staples which are exposed outside the outlet end of the magazine;

a connecting sheet which is capable of moving up and down, the connecting sheet having a through hole, the pressing element including an upper portion and a lower portion, the upper portion is plate-shaped and extending along the longitudinal direction toward the rear end of the main body, a vertical profile of the lower portion being substantially n-shaped, the lower portion having two legs, the two legs defining a staple abutting portion therebetween, the two legs saddling by two sides of the staples which are exposed outside the outlet end of the magazine, the staple abutting portion being for abutting against the staples, the upper portion being disposed through the through hole of the connecting sheet and located on a lower end of the through hole, a second elastic member being arranged between a wall of an upper end of the through hole and the upper portion of the pressing element.

5. The stapler of claim 4, wherein the driving mechanism includes a pressing handle, and when the pressing handle is pressed, the striker strikes the staple that is contacted by the striker in stapler operation.

6. The stapler of claim 4, wherein the wall of the upper end of the through hole of the connecting sheet has a protrusive column, a top face of the upper portion of the pressing element has a protrusion, and two ends of the second elastic member are respectively sleeved on the protrusive column and the protrusion.

* * * * *